United States Patent [19]

Yamazaki et al.

[11] Patent Number: 4,590,142

[45] Date of Patent: May 20, 1986

[54] CAPSULE TONER

[75] Inventors: Masuo Yamazaki, Kawasaki; Toru Matsumoto, Tokyo; Katsutoshi Wakamiya, Yokohama; Ichiro Ohsaki; Toshiaki Nakahara, both of Kawasaki; Hisayuki Ushiyama, Hiratsuka, all of Japan

[73] Assignee: Canon Kabushiki Kaisha, Tokyo, Japan

[21] Appl. No.: 645,404

[22] Filed: Aug. 29, 1984

[30] Foreign Application Priority Data

Sep. 9, 1983 [JP] Japan ..... 58-166150

[51] Int. Cl.[4] ..... G03G 9/08

[52] U.S. Cl. ..... 430/138; 430/106.6; 427/213.36; 428/402.24

[58] Field of Search ..... 427/221; 430/138, 109; 252/316

[56] References Cited

U.S. PATENT DOCUMENTS

| | | | |
|---|---|---|---|
| 4,016,099 | 4/1977 | Wellman et al. | 430/138 |
| 4,187,194 | 2/1980 | Wellman et al. | 427/221 |
| 4,447,516 | 5/1984 | Matkan | 430/138 |

*Primary Examiner*—John L. Goodrow

*Attorney, Agent, or Firm*—Fitzpatrick, Cella, Harper & Scinto

[57] ABSTRACT

A capsule toner, comprising core particles of a core material exhibiting a cloud point within the range of from 30 to 90 and a penetration within the range of from 2 to 15, and a shell material coating the core particles. The capsule toner is preferably formed by dispersing the core particles in solution of the shell material in a good solvent for the shell material, and then adding a poor solvent for the shell material to cause the deposition of the shell material on the core particles.

6 Claims, No Drawings

CAPSULE TONER

BACKGROUND OF THE INVENTION

This invention relates to a toner to be used for development of electrostatic latent images in electrophotography or electrostatic printing, particularly to a capsule toner suited for pressure fixing.

Heretofore, a large number of electrophotographic methods have been known as disclosed in U.S. Pat. No. 2,297,691, Japanese Patent Publication No. 23910/1967 and Japanese Patent Publication No. 24748/1968. Generally speaking, these methods utilize photoconductive materials and comprise the steps of forming an electric latent image on a photoconductive member by various means, subsequently developing the latent image with a toner, optionally transferring the toner image onto a transfer material such as paper, and thereafter fixing by heating, pressure or solvent vapor to give a copy.

The method for sticking the toner onto a material to be fixed thereon by pressurization has been disclosed already in, for example, U.S. Pat. No. 3,269,626 and Japanese Laid-Open Patent Application No. 102624/1973. This method has a large number of advantages such as saving of energy, no pollution, no waiting time for copying due to capability of performing copying by only turning on the power source of the copying machine, no fear of scorching of copies, capability of high speed copying and also simple fixing device.

However, according to such a pressure fixing method of the prior art, no satisfactory fixing characteristic can be obtained unless special treatment is applied on the image supporting member. Besides, the fixing pressure is disadvantageously required to be as high as 200 to 300 $kg/cm^2$. Further, since the toner material for pressure fixing utilizes generally a soft material, it is inherently poor in pot life, the toner particles may agglomerate with each other on standing, until sometimes they are coalesced or blocked, thus causing undesirable phenomena such as filming, carrier staining, and adhesion to fixing roller. With such a background, a large number of microcapsule toners have been proposed in recent years in efforts to produce an ideal toner having overcome the drawbacks as described above. However, even in those capsule toners, there are still many problems to be solved.

For example, the following difficulties may be encountered.

(1) Adhesion between the core particles and the shell material is poor and the microcapsules are inferior in durability.

(2) In the encapsulation step, the core particles are liable to be encapsulated as they are agglomerated or coalesced or encapsulated products are thereafter coalesced with each other, whereby a microcapsule toner with coarse particle sizes is obtained.

(3) When the phase separation method is employed in the encapsulation step, it is difficult to prevent dissolution of the core material into the continuous phase with higher polarity, with the result that independent core particles are produced along with encapsulated particles. On the other hand, even in the case of employing the spraying method, free particles consisting only of core particles are byproduced in a large amount in addition to microencapsulated particles, similarly as in the phase separation method. Further, the particle size distribution is very broad. The by-produced independent particles will consequently cause staining of sleeve and lowering in image density.

(4) When a conventional method is employed in the encapsulation step, due to insufficient wettability between the core particle surfaces and the shell material, it is difficult to completely coat the core surfaces with the shell material, and defective films will frequently be formed. As the result, for example, the microcapsule toner obtained is poor in pot life, the toner particles are susceptible to coalescing or blocking with each other, whereby filming phenomenon tends to occur on the drum surface. Also, other problems such as susceptibility to staining of carrier and further to adhesion to the fixing roller are caused and they can hardly be overcome completely under the present situation.

SUMMARY OF THE INVENTION

An object of the present invention is to provide a capsule toner having effectively overcome such drawbacks.

Another object of the present invention is to provide a microcapsule toner capable of high speed developing and fixing with a sufficiently small pressure.

Still another object of the present invention is to provide a microcapsule toner consisting of only the core material and the shell material without containing any independent particle in the microcapsule toner.

A further object of the present invention is to provide a truely spherical microcapsule toner with sufficient adhesion between the core particles and the shell material, having also stable triboelectric charging characteristic and being also uniform in particle sizes.

It is still another object of the present invention to provide a process for producing a capsule toner endowed with the characteristics as mentioned above.

More specifically, the present invention provides a capsule toner comprising core particles comprising a core material exhibiting a cloud point within the range of from 30 to 90 and a penetration within the range of from 2 to 15 and a shell material coating the core particles.

The above mentioned and other objects and features of the invention will be better understood upon consideration of the following detailed description concluding specific examples of practice.

DETAILED DESCRIPTION OF THE INVENTION

The "cloud point" used herein to define the core material of the present invention is measured according to the method as defined in Japanese Industrial Standards (JIS) K-2266 except for using xylene as the solvent. Specifically, one gram of a sample material is once dissolved in 100 ml of xylene by heating to be dissolved therein, and thereafter the solution is cooled, and the temperature in degrees Celsin (°C.) at which the solution first becomes opaque is defined as the cloud point of the sample material.

The "penetration" used herein also to define the core material of the present invention is measured according to the method as defined in JIS K-2530. Specifically, it is a value of the depth of penetration represented in terms of 0.1 mm as the unit when a needle having a diameter of about 1 mm and a conically shaped tip end with an apex angle of 9° is penetrated under a certain load. The test conditions employed in the present invention were a sample temperature of 25° C., a load of 100 g and a penetration time of 5 seconds.

In the present invention, it is essentially required to employ a material for forming core particles having a cloud point within the range of from 30 to 90 and a penetration within the range of from 2 to 15. If the cloud point is lower than 30, the core material will be partially dissolved into the solution of a shell material when the encapsulation is carried out by use of the coacervation method, with the result that free particles are by-produced. On the contrary, in the case of a cloud point over 90, the core particles and the shell material become poorly wettable with each other, whereby no good contact strength can be obtained nor can be obtained a sufficient film formation characteristic. At the same time, in the present invention, it is essentially required for the core material to have a penetration within the range of from 2 to 15, and a problem in respect of fixing characteristic will be caused with a penetration outside of the specified range.

Also in the method for encapsulation by use of spraying, when a core material with a cloud point lower than 30 is used, the resultant core particles will be partially dissolved in the solution containing the shell material to cause by-production of free particles, while a cloud point over 90 will result in poor wettability of the shell material on the surfaces of core particles and no complete coating is possible with concomitant disadvantages such as formation of defective films, etc.

The materials having cloud points within the range of from 30 to 90 to be used in the present invention may include the materials as shown below, which may be used either singly or in a combination of plural materials:

waxes as represented by carunauba wax, candelilla wax, rice wax, lanolin wax, Japan wax, bees wax, paraffin wax, microcrystalline wax, montanate wax, halogenated paraffin wax, castor wax, shellac wax, sazol wax, amide wax, ozocerite, etc.;

polyolefins, typically polyethylene and polypropylene;

higher fatty acids as represented by palmitic acid and stearic acid, and derivatives thereof;

polyamide resins derived from polyvalent carboxylic acids and polyvalent amines;

rosin, hydrogenated rosin, rosin ester, and modified rosin products as represented by the Diels-Alder reaction product between rosin and maleic anhydride;

polyesters as represented by the polyesters derived from bisphenol A and adipic acid, bisphenol A and sebacic acid, and modified resins thereof;

alkyd resins as represented by the drying oil type alkyd resins, semi-drying oil type alkyd resins, rosin-modified alkyd resins, phenol-modified alkyd resins, styrene-modified alkyd resins, etc.;

phenol resins and modified phenol resins as represented by alkyl phenol resins, natural resin-modified phenol resins, epoxy-modified phenol resins, etc.;

polyamino resins as represented by polyethyleneimine; epoxy resins; styrene resins; styrene copolymers as represented by styrene-alkyl acrylate copolymer and styrene-alkyl methacrylated copolymer; acrylic resins; acrylic copolymers as represented by acrylic acid-alkyl acrylate copolymer, acrylic acid-alkyl methacrylate copolymer, methacrylic acid-alkyl acrylate copolymer and methacrylic acid-alkyl methacrylate copolymer; ethylene-vinyl acetate copolymer; ethylene-vinyl alkyl ether copolymer; ethylene-maleic anhydride copolymer; and others.

Particularly preferable core materials are listed in Table I below.

TABLE I

| Name of resin or wax | Manufacturer | Type of wax | Cloud point (°C.) |
|---|---|---|---|
| Anti-Chek | Sunoco | General paraffin | 32 |
| Carnauba | Noda Wax | Natural wax | 31 |
| AC 405 | Allied Chemicals | Polyethylene copolymer | 57 |
| C-1702 | Allied Chemicals | Polyethylene | 50 |
| M-160 | Sunoco | Micro-crystalline | 44 |
| Wax NE | American Hoechst | Montanate wax | 38 |
| Wax KSL | " | " | 37 |
| Wax R21 | " | Metal salt of montanic acid | 65 |

The above compounds can be used alone or in a combination of two or more kinds as desired so that the wax or the mixture of waxes chosen may have a penetration within the range of from 2 to 15. Preferable combinations are shown in Table II below.

TABLE II

| No. | Composition (weight ratio in the bracket) | Penetration |
|---|---|---|
| 1 | Polyethylene wax (80), Rice wax (20) | |
| 2 | Polyethylene wax (80), Carnauba Wax (20) | 9 |
| 3 | Polyethylene wax (50), Rice wax (50) | 6 |
| 4 | Polyethylene wax (50), Carnauba wax (50) | 5 |
| 5 | Polyethylene wax (50), Paraffin wax (50) | 7 |
| 6 | Polyethylene wax (30), Carnauba wax (70) | 4 |
| 7 | Polyethylene wax (20), Carnauba wax (80) | 3 |
| 8 | Paraffin wax (80), Rice wax (20) | 8 |
| 9 | Paraffin wax (80), Montanate wax (20) | 8 |
| 10 | Polyethylene wax (30), Microcrystalline wax (30), Metal salt of montanic acid (4) | 5 |
| 11 | Polyethylene wax (30), Microcrystalline wax (30), Paraffin wax (40) | 9 |
| 12 | Paraffin wax (30), Carnauba wax (30), Stearic acid (40) | 11 |
| 13 | Rice wax (30), Carnauba wax (30), Paraffin wax (40) | 10 |

The above core material may also be mixed with addition of a solvent or by heating, if necessary, during the preparation of the core particles.

The shell material to be utilized in the present invention may include all materials which are soluble or dispersible in water, organic solvents or miscible mixtures of these. Further, a part of the shell material to be used in the present invention may also be added into the core material.

The shell material may include, for example, polystyrene, poly-monochlorostyrene, methacrylic acid resin, methacrylate resins, polyacrylic acid, acrylate resin, polyethylene oligomer, polyester oligomer, polyamide oligomer, polyurethane oligomer, polybutadiene, polyvinyl acetate, poly(5-ethyl-2-vinylpyridine), diethylaminoethyl methacrylic acid resin, diethylaminoethyl acrylic acid resin, poly(2-methyl-5-vinyl-pyridine), poly(vinylpyrrolidone), etc. The above polymers may be used either alone or as a copolymer of constituent monomers, or sometimes in the state of a mixture dissolved or dispersed in water or an organic or inorganic solvent.

The amount of the shell material may be such that the ratio of the shell film thickness relative to the core particle size (volume average particle size) may be 1 to 30%, particularly preferably 1 to 10%. If the amount of the shell material is less than 1% in terms of the thickness as defined above, the shell material cannot sufficiently cover the surfaces of core particles, whereby marked disadvantages will be caused, such as deficiency in anti-blocking property or durability, filming on the surface of developing sleeve or photoconductive member, adhesion to the fixing roller, etc. due to the defective film. On the other hand, when the amount added is more than 30% according to the above definition, the toner cannot sufficiently be fixed onto the support at a low fixing pressure.

The resin to be used in the present invention may also contain additives such as magnetic powder, water-miscible solvent, charge controller, hardener, flowability controller and stabilizer, as desired, incorporated therein.

The toner of the present invention can contain optionally a colorant which may be chosen as desired. The colorant may be contained in either one or both of the core material and the shell material.

The colorant which can be used in the present invention is inclusive of all the known dyes and pigments, such as carbon black, iron black, nigrosine, Benzidine Yellow, quinacridone, Rhodamine B, Phthalocyanine Blue, etc. The amount of such a dye or pigment may be controlled suitably depending on the dye or pigment employed and the degree of coloration. In order to improve the heat-melt flowability of the core material or to adjust the coloration power or coloration shielding power of the toner, it is preferred to add such a dye or pigment in an amount of 80 % by weight or less, preferably 70% by weight or less, particularly preferably 4 to 60% by weight.

Also, in order to use the toner of the invention as a magnetic toner, it is possible to incorporate magnetic powder, which may be contained in either one or both of the core material and the shell material. For such magnetic powder, a material which can be magnetized when placed in a magnetic field, for example, powder of a ferromagnetic metal such as iron, cobalt, nickel, etc. or compounds such as magnetite, hematite, ferrite, etc. The content of this magnetic powder may be 15 to 70% by weight based on the toner weight.

It is also possible to add additives to the toner of the present invention for various purposes. Such additives may include charge controllers such as metal complexes, nigrosine, etc., compounds having lubrication function such as polytetrafluoroethylene, etc. and plasticizers such as dicyclohexylphthalate, etc. These additives may be added in either one or both of the core material and the shell material.

Further, if desired, the toner of the present invention can also be mixed with carrier particles such as iron powder, glass beads, nickel powder, ferrite powder, etc. for development of electrostatic latent images. Also, for the purpose of improving free flowing property, the toner can also be used as a mixture with hydrophobic colloidal silica powder or, for prevention of toner sticking, as a mixture with fine abrasive particles such as of cerium oxide.

Various encapsulation techniques are available for encapsulation of the capsule toner of the invention. For example, there are the method in which formation of core particles and encapsulation thereof are carried out stepwise, and the method in which core particles and shell are formed at the same time, including the spray dryer method, the interfacial polymerization method, the coacervation method, the phase separation method, the in-situ method, etc., as described in detail in U.S. Pat. Nos. 3,338,991, 3,326,848 and 3,502,582. The particularly preferable method to be used in the present invention, for formation of core particles, is the spray drying method in which the material previously melted is spray dried or the method in which core particles are formed by imparting strong shearing force to the core material in an aqueous medium in the presence of an emulsifier or a suspending agent. As for formation of the shell, it is possible to employ advantageously the method in which the core particles thus obtained are dispersed in a good solvent containing at least one kind of shell material and thereafter a poor solvent for the shell material is gradually added in the dispersion thus formed thereby to cause the shell material to stick onto the core surfaces. The good solvent should preferably give a solubility (concentration of the solute in a saturated solution) at room temperature of 90 wt. % or above, particularly 95 wt. % or above, for the shell material used and a solubility of 5 wt. % or below, particularly 3 wt. % or below, for the core material used. On the other hand, the poor solvent should preferably give a solubility at room temperature of 5 wt. % or below, particularly 3 wt. % or below for the shell material used. If desired, the emulsifier and/or the suspending agent may be removed as the pre-treatment before the encapsulation step.

The present invention will be explained by way of actual examples of practice.

EXAMPLE 1

| | |
|---|---|
| Microcrystalline wax M-160 (produced by Sunoco Co.) | 30 wt. parts |
| Hoechst KSL wax (produced by Hoechst A.G.) | 30 wt. parts |
| Magnetite | 40 wt. parts |

The above materials were kneaded in an attritor while being heated at 120° C. for one hour. The kneaded mixture obtained had a penetration of 8.2 and a cloud point of 42 (°C.).

On the other hand, into a 3-liter separable flask equipped with a homomixer (produced by Tokushu Kiga Kogyo K.K.), 2 parts of colloidal silica "Aerosil 300" (produced by Nihon Aerosil K.K.) and 2 liters of deionized water were added, and the mixture was heated under stirring at 12000 rpm until the inner temperature became 90° C. Into this mixture was thrown the above kneaded product and micropulverization was continued until the particle size of the dispersed particles (volume average particle size utilizing Coulter counter) reached 13 μm. After completion of micropulverization, the dispersion was cooled and caustic soda was added thereto to adjust the pH to 12. After stirring was continued for 4 hours, the product was subjected to filtration by a rotary centrifugal filtrating machine, washing with water and neutralization, followed by drying. Subsequently, encapsulation was performed in the following manner.

| | |
|---|---|
| Core particles as obtained above | 100 wt. parts |
| Styrene-methyl methacrylate-diethylaminoethyl methacrylate terpolymer | 10 wt. parts |
| Acetone | 100 wt. parts |

The above materials were added into a separable flask equipped with a homomixer and the mixture was thoroughly stirred. By adding gradually dropwise methanol into this dispersion, microcapsule toner containing no free particle was obtained. The average thickness of the shells was about 0.2μ.

This toner is called "Sample 1".

EXAMPLE 2

| | |
|---|---|
| Paraffin "Anti-chek" (produced by Sunoco Corp.) | 30 wt. parts |
| Hoechst E wax (produced by Hoechst A.G.) | 30 wt. parts |
| Magnetite | 40 wt. parts |
| Styrene-diethylaminoethyl methacrylate | 2 wt. parts |

The above materials as core materials were kneaded in an attritor under heating at 120° C. for one hour. The kneaded product obtained had a penetration of 9.5 and a cloud point of 55.

On the other hand, into a 3-liter separable flask equipped with a homomixer (produced by Tokushu Kika Kogyo K.K.), 2 parts of colloidal silica "Aerosil 300" and 2 liters of deionized water were added, and the mixture was heated under stirring at 12000 rpm until the inner temperature became 90° C. Into this mixture was thrown the above kneaded product and granulation was continued until the particle size of the dispersed particles reached 13 μm. Subsequently, encapsulation was performed as follows.

| | |
|---|---|
| Core particles as obtained above | 100 wt. parts |
| Styrene-methyl methacrylate-diethylaminoethyl methacrylate terpolymer | 10 wt. parts |
| Acetone | 100 wt. parts |

The above dispersion was atomized by discharging through a spray drying device equipped with a dual fluid nozzle to form microcapsule toner containing no free particle (average thickness of the shells: about 0.2μ).

This toner is called "Sample 2".

EXAMPLES 3-6

Example 1 was repeated except for employing the core materials as shown below, respectively.

| Example No. | Core material composition (numerals in bracked are weight parts added) | Penetration | Cloud point |
|---|---|---|---|
| 3 | Paraffin "Anti-chek" (50), Carnauba wax (10), Magnetite (40), Styrene-diethylaminoethyl methacrylate copolymer (2) | 3.0 | 32 |
| 4 | M-160 (30), Hoechst E wax (30), Magnetite (40) Styrene-diethylaminoethyl methacrylate copolymer (2) | 7.0 | 45 |
| 5 | AC 405 (30), Paraffin "Anti-chek" (20), Wax NE (10), Magnetite (40), Polydimethylaminoethyl methacrylate (2) | 3.1 | 47 |
| 6 | AC 405 (30), Stearic acid (5), Wax NE (5), Magnetite (40), Polydiethylaminoethyl methacrylate (2) | 5.2 | 37 |

COMPARATIVE EXAMPLE

The following materials were employed for the core material:

| | |
|---|---|
| Carnauba wax | 20 parts by weight |
| Stearic acid | 20 parts by weight |
| Montanate wax (Hoechst wax NE) | 20 parts by weight |
| Magnetite | 40 parts by weight |

According to the same procedure as in Example 1, microcapsule toner was obtained. The core material had a penetration of 1 and a cloud point of 20.

With the use of the microcapsule toners obtained in the above examples, image formation was performed by means of an improved Model of PC-10 (produced by Canon K.K.). Fixing was effected by a fixer in which metal rollers with a line pressure of 10 kg/cm were provided. The results are shown in Table III.

TABLE III

| Example No. | Image density | Triboelectric charge (μC/g) | Agglomeration degree | Fixability |
|---|---|---|---|---|
| 1 | 1.0 | 12.4 | 22.9 | Good |
| 2 | 1.7 | 24.2 | 16.5 | Good |
| 3 | 1.6 | 15.1 | 25.5 | Good |
| 4 | 1.1 | 21.9 | 19.2 | Good |
| 5 | 1.5 | 23.7 | 20.8 | Good |
| 6 | 1.2 | 20.5 | 24.8 | Good |
| Comparative Example | 0.6 | 5.6 | 45.5 | Bad |

The triboelectric charges shown in Table III were determined by measuring the relative triboelectrication generated through contact of carrier particles with toner particles by means of a Faraday gauge. This device was made of a stainless steel cylinder having a diameter of 2.54 cm (1 inch) and a length of 2.54 cm (1 inch). One sheet of screen was positioned at each end of the cylinder, and the openings on the screen were so sized that the toner particles could pass therethrough but the carrier particles could not. This Faraday gauge was first weighed, then about 0.5 g of carrier particles and toner particles were placed therein, the gauge was weighed again and connected to the input of a Coulomb meter. Then, the gauge was subjected to suction to expel all the toner particles and leave the carrier particles. After removal of the electrostatically charged toner particles from the Faraday gauge, the carrier particles charged to the opposite polarity thereto were caused to discharge the same amount of electric charge through the Coulomb meter to the ground. This charge was measured by the Coulomb meter. This charge was regarded as the charge existing on the toner. Next, the cylinder was weighed again to measure the toner removed. By use of the data thus obtained, it was possible to calculate the toner concentration and the average charge relative to the mass ratio of the toner.

In the above Table III, image density, agglomeration degree and fixability were measured as follows, and the measured results have the technical significances as described below.

The agglomeration degree was measured by placing a sample toner on a sieve, vibrating the sieve and measuring the amount of toner remaining on the toner. A greater proportion of the toner remaining on the siever indicates a greater agglomeration degree. More specifically, a sieve system comprising a 60-mesh screen, a 100-mesh screen and a 200-mesh screen arranged in the order named from the above was used, and 2 g of a sample toner was placed on the 60-mesh screen of the sieve system which was then placed on a vibrator table actuated by applying a voltage of 2.5 V thereto and vibrated for 40 seconds. After the vibration, the amounts of the sample toner remaining on the 60-mesh, 100-mesh and 200-mesh screens were measured and denoted as A grams, B grams and C grams, respectively. The agglomeration degree listed in Table III was calculated according to the following scheme:

$$\frac{A \times 0.5 + B \times 0.3 + C \times 0.1}{2} \times 100$$

wherein 0.5, 0.3 and 0.1 are weight factors for the 60-mesh, 100-mesh and 200-mesh screens, respectively.

The fixability in Table III was determined in a manner similar the method for evaluation of the color fastness to rubbing (defined in JIS-L 0849-1971). Thus, a white cotton cloth was placed on a toner face of a sample record paper and they were rubbed with each other by using a rubbing tester (dry test). After taking off the record paper, the degree of coloring on the white cloth was evaluated by comparing it with a grey scale for staining and classified into 10 degrees ranging from grade 1 (worst) to grade 10 (best). Grades 1 and 2 mean practically insufficient fixability, grade 3 or above, preferably grade 4 or above, means a practically sufficient fixability. Herein, grade 4 or above was designated "good" while grade 3 or below "bad".

What is claimed is:

1. A capsule toner comprising solid core particles and a shell material coating each of said solid core particles in which said solid core particles are comprised of a core material of a wax or a mixture of waxes exhibiting a cloud point within the range of from 30 to 90 and a penetration within the range of from 2 to 15, said capsule toner being obtained by dispersing said solid core particles in a solution of a shell material in a solvent for said shell material and encapsulating each of said solid core particles with said shell material by spraying the resultant dispersion or by a phase separation method comprising adding gradually a poor solvent for said shell material into the resultant dispersion.

2. A capsule toner according to claim 1, wherein at least one of the solid core particle and the shell material contains magnetic powder.

3. A capsule toner according to claim 1, wherein the shell material is a resin selected from the group consisting of polystyrene, poly-monochlorostyrene, methacrylic acid resin, methacrylate resins, polyacrylic acid, acrylate resin, polyethylene oligomer, polyester oligomer, polyamide oligomer, polyurethane oligomer, polybutadiene, polyvinyl acetate, poly (5-ethyl-2-vinylpyridine), diethylaminoethyl methacrylic acid resin, diethylaminoethyl acrylic acid resin, poly(2-methyl-5-vinylpyridine), poly(vinylipyrrolidone), and a copolymer of constituent monomers of the polymers mentioned above.

4. A capsule toner according to claim 3, wherein the thickness of the shell material is 1 to 30% of the average particle size of the core particles.

5. A process for producing a capsule toner, which comprises (i) forming solid core particles from a core material of a wax or a mixture of waxes exhibiting a cloud point within the range of from 30 to 90 and a penetration within the range of from 2 to 15, (ii) dispersing said solid core particles in a solution of a shell material in a good solvent for said shell material, and (iii) encapsulating each of said solid core particles with said shell material by spray-drying the resultant dispersion or by a phase separation method comprising adding gradually a poor solvent for said shell material into the resultant dispersion.

6. A process according to claim 5, wherein the good solvent for the shell material gives a solubility at room temperature of 90 wt. % or above for the shell material and 5 wt. % or below for the core material, and the poor solvent for the shell material gives a solubility at room temperature of 5 wt. % or below for the shell material.

* * * * *

UNITED STATES PATENT AND TRADEMARK OFFICE

CERTIFICATE OF CORRECTION

PATENT NO. : 4,590,142

DATED : MAY 20, 1986

INVENTOR(S) : MASUA YAMAZAKI, ET AL.

It is certified that error appears in the above-identified patent and that said Letters Patent is hereby corrected as shown below:

COLUMN 3

Line 34, "bees wax," should read --beeswax,--.

COLUMN 4

Line 28, "Penetration" should read --Penetration--.

9 9

Signed and Sealed this

Seventeenth Day of March, 1987

*Attest:*

DONALD J. QUIGG

*Attesting Officer*

*Commissioner of Patents and Trademarks*